US005795406A

United States Patent [19]

Kawamura et al.

[11] Patent Number: 5,795,406

[45] Date of Patent: Aug. 18, 1998

[54] CEMENTATION METHOD OF METALS

[75] Inventors: Toshiyuki Kawamura; Hitoshi Goi; Fumitaka Abukawa, all of Tokyo, Japan

[73] Assignee: Dowa Mining Co., Ltd., Tokyo, Japan

[21] Appl. No.: 770,176

[22] Filed: Dec. 19, 1996

[30] Foreign Application Priority Data

Dec. 28, 1995 [JP] Japan ..... 7-352428

[51] Int. Cl.[6] ..... C21D 1/06; C23C 8/20

[52] U.S. Cl. ..... 148/216; 148/235

[58] Field of Search ..... 148/208, 216, 148/235, 634

[56] References Cited

U.S. PATENT DOCUMENTS 4,992,113 2/1991 Baldo et al. ..... 148/216

FOREIGN PATENT DOCUMENTS

128577/1980 3/1979 Japan .
21866/1987 2/1982 Japan .
38870/1989 12/1984 Japan .
60-228664 11/1985 Japan ..... 148/216
51904/1994 7/1990 Japan .
49621/1994 8/1991 Japan .
2092183 8/1982 United Kingdom ..... 148/216

*Primary Examiner*—Deborah Yee
*Attorney, Agent, or Firm*—Nilles & Nilles, S.C.

[57] ABSTRACT

In a cementation method of metals in which hydrocarbon gas and oxidization gas are introduced into a heat treatment furnace, a small quantity of hydrocarbon gas of is introduced at a low pressure into the heat treatment furnace. The shift time and the gradient of the carbon potential varying toward a predetermined high or low level are controlled by increasing or decreasing the quantity of cementation gas and oxidization gas to be supplied to the furnace. After the carbon potential is reached to the high or low level, the carbon potential is maintained for a predetermined time period so as to prevent the deposited carbide from being bulked. In order to prevent the gas supply pipe from being choked with the soot of the hydrocarbon, oxidization gas of intermediate pressure is flushed into the gas supply pipe. In order to prevent the components of the atmosphere in the furnace from varying due to the change in furnace pressure when the door is opened or closed, hydrocarbon gas of a low pressure and oxidization gas of an intermediate pressure are added in the conversion pipe in the preheating zone. $CO_2$ of intermediate pressure is supplied into each gas supply pipe at the same time in order to remove the soot in each of the gas supply pipes and to prevent the lack of CO to be introduced into the furnace.

16 Claims, 3 Drawing Sheets

CEMENTATION METHOD OF METALS

BACKGROUND OF THE INVENTION

1. Field of the Invention

This invention relates to a cementation method of metals, and more particularly relates to a cementation method of metals, wherein hydrocarbon gas and oxidization gas are introduced into a heat treatment furnace in order to prevent a deposited carbide from being bulked, so that the treatment time is shortened to enhance the reproducibility, and that sooting is prevented to reduce the maintenance costs or the like.

2. Description of the Prior Art

FIG. 3 shows a conventional batch furnace. In FIG. 3, a reference numeral 1 denotes a heating room, 2 denotes a cooling room, 3 an entrance door for said heating room 1, 3*a* an opening and closing port formed on said entrance door 3, 4 an intermediate door, 4*a* an outlet formed on said intermediate door 4, 5 an outlet door for said cooling room 2, 6 a cooling oil tank, 7 an excess air exhausting device, 8 a curtain flame to be ignited when the outlet door 5 is opened, 9 and 10 gas supply pipes, 11 and 12 valves provided in said gas supply pipes 9 and 10, respectively, and 19 an agitating fan.

FIG. 4 shows a conventional continuous furnace and parts of the furnace which are similar to the corresponding parts of the furnace shown in FIG. 3 have been given corresponding reference numerals and need not be further described.

A reference numeral 15 denotes a work receiving room, 16 a door for the work receiving room 15, 17 a $CO_2$ supply pipe, 18 is valve provided in said $CO_2$ supply pipe 17, and 20 a gas material supply pipe.

In the conventional cementation method, a converted gas obtained from the conversion furnace is used as a carrier gas. Recently, in order to enhance the quality, and to reduce the treatment time and running cost, such a method that the conversion furnace is not used, but a hydrocarbon gas and an oxidation gas are introduced directly into the furnace to carry out the metamorphism and the cementation in the furnace. Further, a cementation method in which that the carbon potential in the furnace atmosphere is increased and decreased repeatedly to reduce the treatment time is described in Japanese Patent Laid Open Nos. 128577/1980 and 49621/1994, Japanese Patent Publication Nos. 21866/1987, 38870/1989 and 51904/1994, for example.

FIG. 5 is a graph showing the relation between a temperature curve a and a carbon potential curve b in an example of the conventional cementation method. In this method, a work inserted into a furnace for processing is heated to and maintained at a temperature of austenite region, such as 930° C. in a cementation atmosphere. The work is cementated for a predetermined time at a carbon potential of about 0.8%, subjected to diffusion process at a carbon potential of about 0.7%, and then cooled to and hardened at 850° C.

FIG. 6 shows a cementation method in the Japanese Patent Laid-Open No. 49621/1994. In this method, during the cementation process, the carbon potential Is varied to about 1.1% and about 0.8%, alternatively so as to reduce the cementation time and to prevent the furnace from being sooted.

The cementation time can be reduced if the cementation is carried out in an atmosphere of higher carbon potential. However, in most cases, the work to be treated includes special chemical elements therein which easily deposit carbides. Accordingly, if the carbon potential of the atmosphere in the furnace is set to a high level carelessly, the deposited carbide causing the fatigue strength of the work to be lowered is bulked, and the cementation time cannot be reduced.

SUMMARY OF THE INVENTION

An object of the present invention is to obviate the above defect of the conventional cementation method.

In a cementation method of metals of the present invention wherein hydrocarbon gas and oxidization gas are introduced into a heat treatment furnace, a small quantity of hydrocarbon gas of a low pressure is introduced into the heat treatment furnace in order to form an initial atmosphere. Further, in the present invention, a shift time and a gradient of a carbon potential varying toward different level are controlled by increasing or decreasing the quantities of hydrocarbon gas and oxidization gas.

Further, in the present invention, a carbon potential of the atmosphere in the furnace is maintained for a predetermined time at such a high level as to prevent a carbide deposited in a work to be processed from being bulked when a cementation process is carried out, and wherein the carbon potential is maintained for a predetermined time at a low level so as to carry out the solution treatment of the deposited carbide when the cementation process is carried out.

Further, in the present invention, oxidization gas of intermediate pressure is flushed into a gas supply pipe so as to prevent the gas supply pipe from being sooted.

Further, in the present invention, hydrocarbon gas of a low pressure and oxidization gas of an intermediate pressure are supplied into a conversion pipe in a preheating zone so as to prevent components of atmosphere in the furnace from being disturbed. The intermediate pressure is a pressure between a low pressure (not higher than 0.025 kg/cm$^2$) and a high pressure (not less than 10 kg/cm$^2$).

Furthermore, in the present invention, $CO_2$ of an intermediate pressure is injected into all gas supply pipes at the same time so as to remove a soot from each of said gas supply pipes and to prevent the lack of CO in the furnace.

The foregoing and other objects, features, and advantages of the present invention will become apparent from the following more particular description of a preferred embodiment of the invention, as illustrated in the accompanying drawings.

DESCRIPTION OF THE PREFERRED EMBODIMENT

Figure 3:
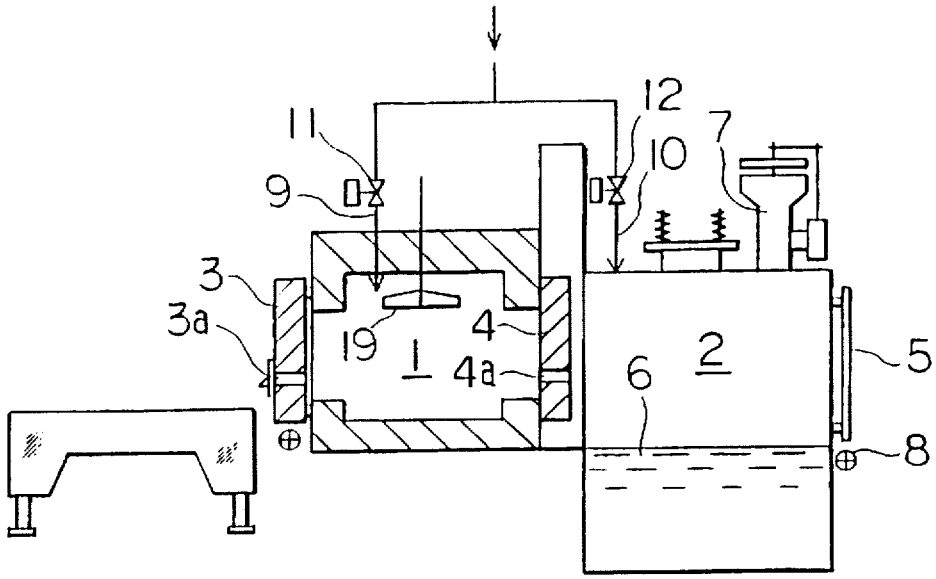
FIG. 3 PRIOR ART
FIG. 3 is a sectional side view of a conventional batch furnace.
Figure 4:
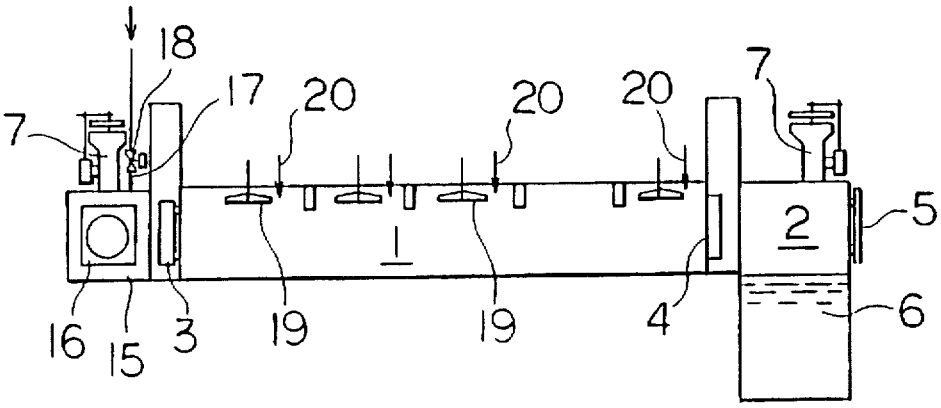
FIG. 4 PRIOR ART
FIG. 4 is a sectional side view of a conventional continuous furnace.

In the present invention, wherein the batch furnace as shown in FIG. 3 is used, the entrance door 3 for the heating room 1 is opened, the rotation of the agitating fan 19 in the heating room 1 is stopped in order to prevent outside air from entering the heating room 1, and a work such as steel etc. to be treated is inserted through the entrance door 3 into the heating room 1.

Then, the entrance door 3 is closed, and oxidization gas such as $CO_2$ of an intermediate pressure is introduced into the heating room 1 and, at the same time, the opening and closing port 3*a* is opened in order to purge to the outside air that entered into the heating room 1 when the work is introduced thereinto.

After that, a small quantity of hydrocarbon gas such as $C_4H_{10}$ of an intermediate pressure (0.025 kg/cm$^2$–0.1 kg/cm$^2$, preferably 0.07 kg/cm$^2$) is introduced into the heating room 1 at a rate of 10–200 liters/minute, preferably 40 liters/minute, and the opening and closing port 3*a* is closed. Then, the agitating fan 19 is rotated, and the work is heated to about 930° C. without adding any catalyst so as to carry out the cementation and diffusion processes.

Next, the work is cooled at the hardening temperature of about 850° C. Then, the intermediate door 4 is opened, and the work is moved to the cooling room 2. Then, the work is lowered by an elevator (not shown) into the cooling oil tank 6 so as to carry out the hardening for about 15 minutes. After that, the work is lifted from the cooling oil tank 6 and remain for about 10 minutes in order to drop the oil from the work. Then, the outlet door 5 is opened, and the work is taken out therefrom. When the intermediate door 4 is opened and the work is moved to the cooling room 2, air in the cooling room 2 is expanded due to the heat radiation from the heating room 1 and the heated work. When the intermediate door 4 is closed the, heat radiation to the cooling room 2 from the heating room 1 is shut off. Accordingly, when the work are dipped into the cooling oil in the cooling oil tank 6, the pressure in the cooling room 2 becomes negative. In order to prevent the pressure in the cooling room 2 from becoming negative, the valve 12 is opened and $CO_2$ of intermediate pressure is supplied through the gas supply pipe 10 to the cooling room 2.

In case that the continuous furnace is used, a predetermined quantity of oxidization gas is introduced into the cementation and diffusion zones, and hydrocarbon gas is introduced into the preheating, cementation, diffusion and hardening zones.

In the present invention, the quantity of hydrocarbon gas introduced into each of said zones is adjusted according to the signals all from an $O_2$ sensor, a $CO_2$ infrared analyzer, a CP coil, and dew point with respect to each of the zones so that a predetermined carbon potential (activity) can be obtained.

As stated above, by the control of the gas quantity, not air quantity, the production of soot can be suppressed.

Figure 1:
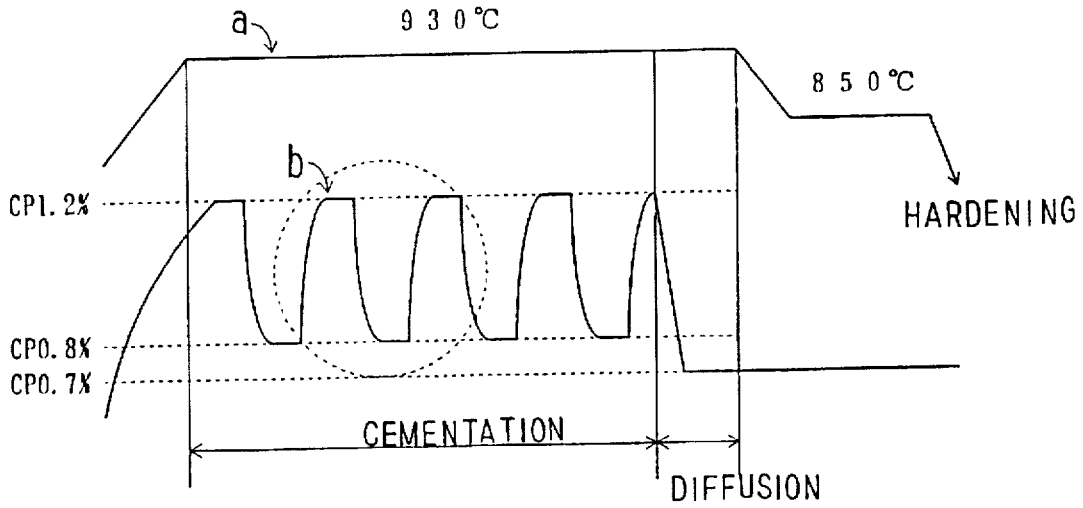
FIG. 1 is a graph explaining a cementation method of metals in accordance with the present invention.
Figure 2:
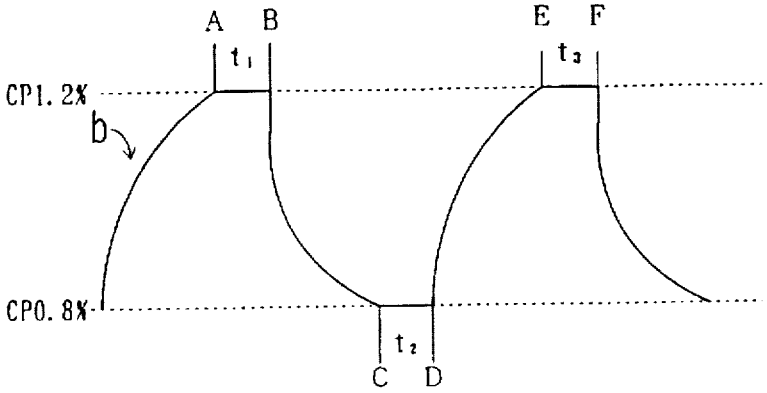
FIG. 2 is an enlarged view of a portion shown in FIG. 1.

That is, as shown in FIGS. 1 and 2, the carbon potential is varied repeatedly from about 1.2% to about 0.8% and vice versa in the process of cementation and maintained at 1.2% or 0.8% for a predetermined time. The gradients of the curve b between the positions B-C and D-E, and values of the maintaining times $t_1$, $t_2$, $t_3$, . . . are set suitably so that the deposited carbide is not bulked, that the cementation time is reduced, and that the production of soot in the furnace is prevented effectively.

Table 1 shows an outer ring of SCM 420H (75 mm in outer diameter, 57 mm in inner diameter) processed by the cementation method of the present invention shown in FIG. 1 for comparison. In this case, the temperature of the cementation and diffusion is set to 930° C., and the target of hardened thickness of effective layer is set between 1.45 mm to 1.90 mm (Hv 513).

TABLE 1

Figure 5:
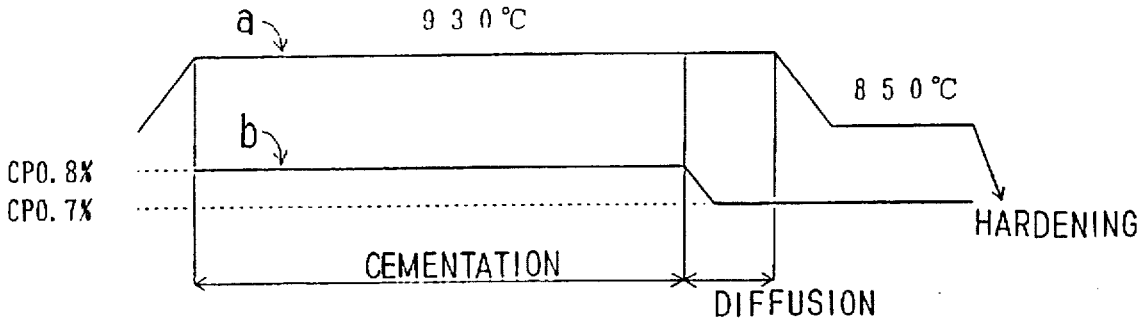
FIG.5 PRIOR ART
FIG. 5 is a graph explaining a conventional cementation method of metals.
Figure 6:
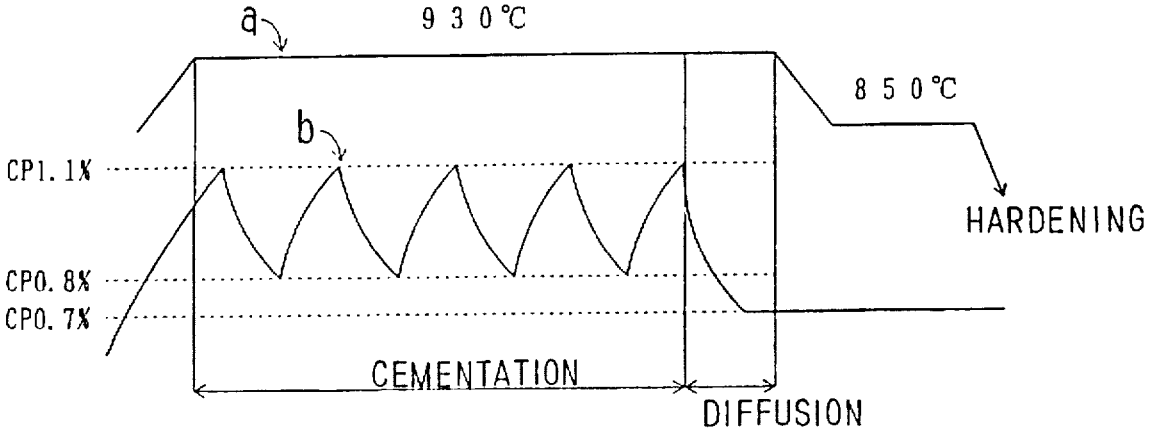
FIG.6 PRIOR ART
FIG. 6 is a graph explaining other conventional cementation method of metals.

| | CONVENTIONAL METHOD SHOWN IN FIG. 5 | METHOD OF JAPANESE PATENT LAID-OPEN NO. 49621/1994 SHOWN IN FIG. 6 | METHOD OF PRESENT INVENTION SHOWN IN FIG. 1 |
|---|---|---|---|
| CEMENTATION TIME | 350 min. | 450 min. | 420 min. |
| DIFFUSION TIME | 350 min. | 45 min. | 45 min. |
| TOTAL PROCESSING TIME | 700 min. | 495 min. | 465 min. |

As apparent from said Table 1, according to this embodiment of the present invention, it is possible to reduce the total processing time by 235 minutes in comparison with the conventional method shown in FIG. 5, and to reduce by 30 minutes in comparison with the method shown in the Japanese Patent Laid-Open No. 49621/1994.

If the carbon potential of the atmosphere in the furnace is increased more than the solid solution limit of carbon at the austenite region temperature is continued, the deposited carbide in the work becomes bulked. Accordingly, in the present invention, the shift time and the gradient varying of the carbon potential toward a predetermined high level are controlled by increasing the quantity of cementation gas to be supplied to the furnace or by decreasing the quantity of oxidization gas to be supplied to the furnace, and after the carbon potential reaches the high level, the carbon potential is maintained for a predetermined time period so as to prevent the carbide deposited in the work from being bulked. After that, the carbon potential of the atmosphere in the furnace is lowered to a predetermined low level in order to carry out the solution treatment of the deposited carbide into the austenite. At this stage, the cementation time becomes excess if the carbon potential is lowered to a value lower than a required value carelessly. Accordingly, in the present invention, the shift time and the gradient of the carbon potential varying toward a predetermined low level are controlled by decreasing the quantity of cementation gas to be supplied to the furnace or by increasing the quantity of oxidization gas to be supplied to the furnace. After the carbon potential is reached to the low value, the carbon potential is maintained for a predetermined time of period. These steps are repeated, and diffusion is carried out for a suitable time period as in the conventional manner, so that the surface carbon density is adjusted. The shift time and the gradient of the carbon potential as well as the time during which the carbon potential is maintained at the high level or the low level, may be varied suitably with time, because the diffusion of carbon in the work is reduced with time.

In order to prevent the gas supply pipe from being choked with the soot of the hydrocarbon, oxidization gas of intermediate pressure is flushed timely into said gas supply pipe at a rate of 2–10 kg/cm$^2$, preferably 5 kg/cm$^2$.

Further, in order to prevent the components of the atmosphere in the furnace from being varied due to the change in furnace pressure when the door is opened or closed, hydrocarbon gas of an intermediate pressure (0.025 kg/cm$^2$–0.1 kg/cm$^2$, preferably 0.07 kg/cm$^2$) and oxidization gas of an intermediate pressure (2–10 kg/cm$^2$, preferably 5 kg/cm$^2$) are added by a supercharger in the conversion pipe in the preheating zone.

Furthermore, in the present invention, $CO_2$ of intermediate pressure is supplied into each gas supply pipe at the same time in order to remove the soot in each of the gas supply pipes. This procedure is contrary to the conventional method wherein $CO_2$ is supplied into each gas supply pipe in each cycle.

According to the present invention, the problem of lack of CO to be introduced into the furnace can be solved, and the time for the cementation can be reduced remarkably.

As stated above, according to the present invention, the processing time of the cementation of metals can be reduced, and the cementation method of metals is carried out economically.

While the invention has been particularly shown and described with reference to the preferred embodiments thereof, it will be understood by those skilled in the art that various changes in form and details may be made therein without departing from the spirit and scope of the invention as defined by the appended claims.

What is claimed is:

1. A cementation method of metals, comprising:

introducing an oxidization gas into a heat treatment furnace for cementation of a metal in said furnace; and introducing a small quantity of a hydrocarbon gas at a low pressure of between 0.025 Kg/cm$^2$ and 0.1 Kg/cm$^2$ into the heat treatment furnace in order to form an initial atmosphere.

2. The cementation method of metals as claimed in claim 1, further comprising controlling a shift time and a gradient of a carbon potential varying toward a different level by increasing or decreasing the quantities of the hydrocarbon gas and the oxidization gas.

3. The cementation method of metals as claimed in claim 1, further comprising 1) maintaining a carbon potential of the atmosphere in the furnace at a sufficiently high level to prevent a carbide deposited in a work to be processed from being bulked when a cementation process is carried out, and 2) maintaining the carbon potential at a sufficiently low level to carry out the solution treatment of the deposited carbide when the cementation process is carried out.

4. A cementation method of metals, comprising:

introducing an oxidization gas into a heat treatment furnace;

introducing a small quantity of a hydrocarbon gas of a low pressure into the heat treatment furnace in order to form an initial atmosphere; and flushing an oxidization gas of intermediate pressure into a gas supply pipe so as to prevent the gas supply pipe from being sooted.

5. The cementation method of metals as claimed in claim 2, further comprising flushing an oxidization gas of intermediate pressure into a gas supply pipe so as to prevent the gas supply pipe from being sooted.

6. The cementation method of metals as claimed in claim 3, further comprising flushing an oxidization gas of intermediate pressure into a gas supply pipe so as to prevent the gas supply pipe from being sooted.

7. A cementation method of metals, comprising:

introducing an oxidization gas into a heat treatment furnace;

introducing a small quantity of a hydrocarbon gas of a low pressure into the heat treatment furnace in order to form an initial atmosphere; and supplying a hydrocarbon gas of a low pressure and an oxidization gas of an intermediate pressure into a conversion pipe in a preheating zone so as to prevent components of atmosphere in the furnace from varying.

8. The cementation method of metals as claimed in claim 2, further comprising supplying a hydrocarbon gas of a low pressure and an oxidization gas of an intermediate pressure into a conversion pipe in a preheating zone so as to prevent components of atmosphere in the furnace from varying.

9. The cementation method of metals as claimed in claim 3, further comprising supplying a hydrocarbon gas of a low pressure and an oxidization gas of an intermediate pressure into a conversion pipe in a preheating zone so as to prevent components of atmosphere in the furnace from varying.

10. The cementation method of metals as claimed in claim 4, further comprising supplying a hydrocarbon gas of a low pressure and an oxidization gas of an intermediate pressure into a conversion pipe in a preheating zone so as to prevent components of atmosphere in the furnace from varying.

11. A cementation method of metals, comprising:

introducing an oxidization gas into a heat treatment furnace;

introducing a small quantity of a hydrocarbon gas of a low pressure into the heat treatment furnace in order to form an initial atmosphere; and injecting $CO_2$ of an intermediate pressure into all gas supply pipes at the same time so as to remove a soot from each of said gas supply pipes and to prevent the lack of CO in the furnace.

12. The cementation method of metals as claimed in claim 2, further comprising injecting $CO_2$ of an intermediate pressure into all gas supply pipes at the same time so as to remove a soot from each of said gas supply pipes and to prevent the lack of CO in the furnace.

13. The cementation method of metals as claimed in claim 3, further comprising injecting $CO_2$ of an intermediate pressure into all gas supply pipes at the same time so as to remove a soot from each of said gas supply pipes and to prevent the lack of CO in the furnace.

14. The cementation method of metals as claimed in claim 4, further comprising injecting $CO_2$ of an intermediate pressure into all gas supply pipes at the same time so as to remove a soot from each of said gas supply pipes and to prevent the lack of CO in the furnace.

15. The cementation method of metals as claimed in claim 7, further comprising injecting $CO_2$ of an intermediate pressure into all gas supply pipes at the same time so as to remove a soot from each of said gas supply pipes and to prevent the lack of CO in the furnace.

16. The cementation method of metals as claimed in claim 1, wherein the hydrocarbon gas is introduced at a pressure of about 0.07 Kg/cm$^2$.

* * * * *